US007080661B1

(12) United States Patent
Ayer et al.

(10) Patent No.: US 7,080,661 B1
(45) Date of Patent: Jul. 25, 2006

(54) FLUID AMPLIFIER WITH FILTER AND CLEAN-OUT DOOR

(75) Inventors: George Ayer, Concord (CA); Michael J. Philips, St. Thomas (CA)

(73) Assignee: Crystal Fountains Inc., Concord (CA)

( * ) Notice: Subject to any disclaimer, the term of this patent is extended or adjusted under 35 U.S.C. 154(b) by 0 days.

(21) Appl. No.: 11/133,180

(22) Filed: May 20, 2005

(51) Int. Cl.
*E03B 3/18* (2006.01)
*F15C 1/08* (2006.01)

(52) U.S. Cl. ..... 137/550; 137/833; 137/834

(58) Field of Classification Search ..... 137/833, 137/834, 550
See application file for complete search history.

(56) References Cited

U.S. PATENT DOCUMENTS 3,390,691 A * 7/1968 Jones ..... 137/834
3,528,445 A * 9/1970 Shinn et al. ..... 137/833
4,716,936 A * 1/1988 Mon et al. ..... 137/833
6,457,658 B1 * 10/2002 Srinath et al. ..... 239/589.1

* cited by examiner

*Primary Examiner*—A. Michael Chambers
(74) *Attorney, Agent, or Firm*—Bereskin & Parr

(57) ABSTRACT

A fluid amplifier having a filter interposed in an upstream conduit for filtering the power stream. The interior surface of the upstream conduit downstream from the filter is sealed to impede debris from being introduced to the power stream downstream from the filter.

13 Claims, 5 Drawing Sheets

OPERATION WITH FILTER

OPERATION WITH
FILTER

FLUID AMPLIFIER WITH FILTER AND CLEAN-OUT DOOR

FIELD OF THE INVENTION

This invention relates generally to fluid amplifiers for decorative fountains. More particularly, it relates to a fluid amplifier incorporating a filter and clean-out door for managing upstream flow and for reducing the risk of malfunction due to debris.

BACKGROUND OF THE INVENTION

Fluid amplifiers rely on a fluid control stream to switch a fluid power stream. Decorative fountain systems employ fluid amplifiers to generate their decorative displays and effects.

Fluid amplifiers are so named because a low-energy fluid control signal can control and switch a high-energy fluid power stream to produce an output signal of higher energy level than the fluid control signal. In fluid amplifiers, a fluid power stream, after leaving a nozzle, is switched selectively to one or more of a plurality of outlet passages. This may be done by supplying fluid control pressure continuously, or as a pulse, to one of the control ports at the exit end of the nozzle until the high-energy power stream is diverted. Alternatively, switching may be effected by closing the other control port so that the fluid that is flowing in through one control port from the atmosphere or some other source will create a sufficient fluid pressure imbalance adjacent the exit end of the nozzle to effect switching of the fluid power stream.

In use, a fluid amplifier would typically be connected to, and receive the high-energy power stream from, a separate fluid supply manifold that had been previously installed.

SUMMARY OF THE INVENTION

In accordance with an aspect of the present invention, there is provided a fluid amplifier comprising: an interaction chamber; an upstream conduit for issuing a power stream flow into the interaction chamber; a plurality of output channels located downstream of the interaction chamber; a first control stream channel in fluid communication with the interaction chamber for controllably directing a first control fluid flow into the interaction region; a second control stream channel in fluid communication with the interaction chamber for controllably directing a second control fluid flow into the interaction region; and, a filter interposed in the upstream conduit for filtering the power stream, wherein an interior surface of the upstream conduit downstream from the filter is sealed to impede debris from being introduced to the power stream downstream from the filter.

BRIEF DESCRIPTION OF THE DRAWINGS

For a better understanding of the present invention, and to show more clearly how it may be carried into effect, reference will now be made by way of example to the accompanying drawings, in which.

DETAILED DESCRIPTION OF PREFERRED EMBODIMENTS OF THE INVENTION

Figure 1:
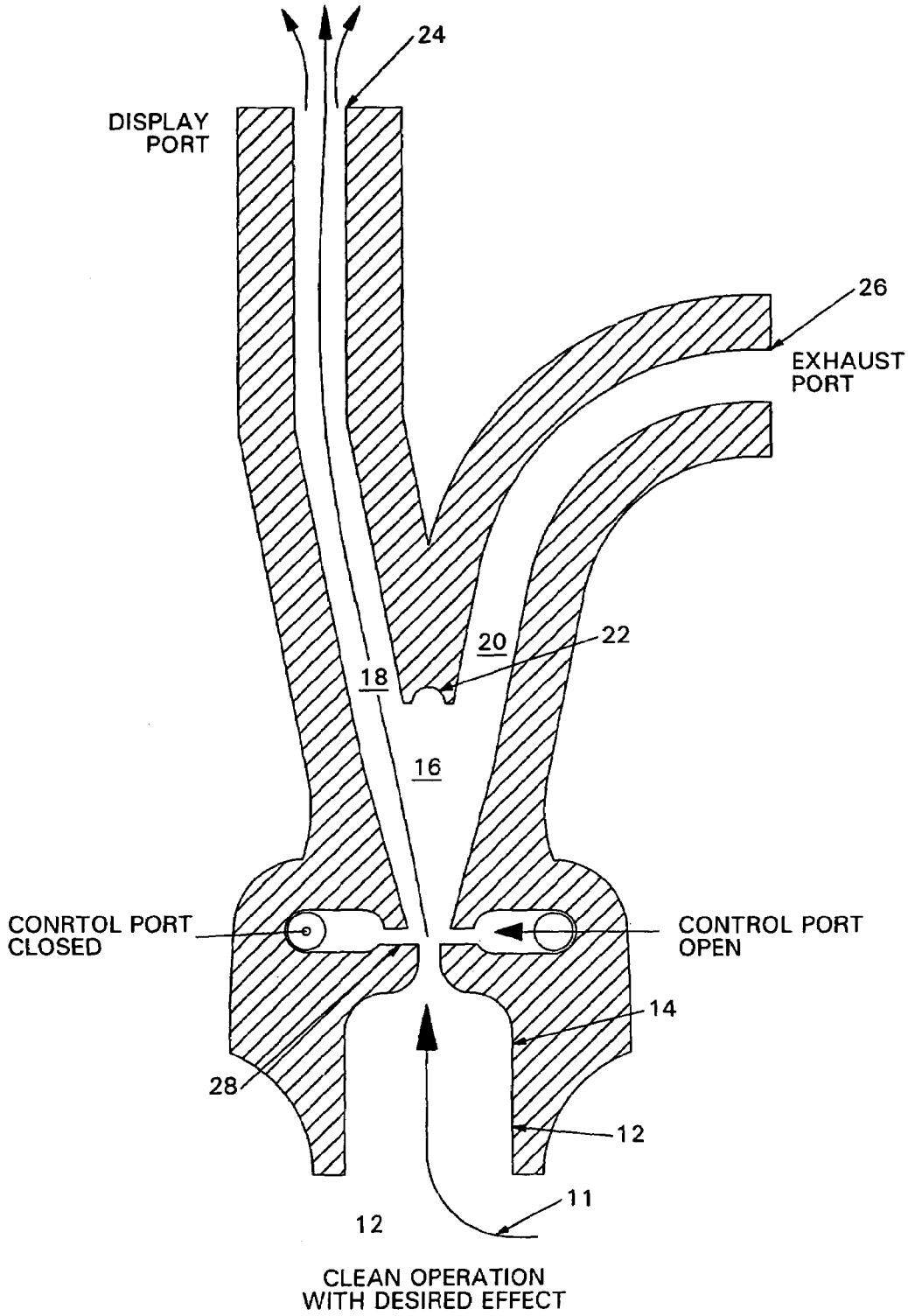
FIG. 1, in a cross-sectional view, illustrates a fluid amplifier.

Referring to FIG. 1, there is illustrated in a sectional view a fluid amplifier. Fluid amplifier 10 comprises a plurality of interconnected fluid channels formed in a body of fluid impervious material. A power stream input channel 12 receives an input stream 11 via a supply line from a pump or other fluid source (not shown) with sufficient flow and pressure to create the desired visual water effect. Input channel 12 terminates at a power nozzle 14. Power nozzle 14 is, in turn, in fluid communication with a fluid interaction chamber 16. Power nozzle 14 produces a power stream flow, from input stream 11 which emerges into the interaction chamber 16. Branching from the interaction chamber 16 are two power stream output channels 18 and 20, either of which are capable of receiving the entire power stream from power nozzle 14. These power stream output channels 18 and 20 diverge at a splitter 22. The first power stream output channel 18 communicates with a display port 24, which is used to create a primary effect, such as a vertical fountain. The second power stream output channel 20 communicates with an exhaust port 26, which is connected to an elbow (not shown) that directs the fluid back into the fountain basin. Alternatively, the second exhaust port 26 could be used to create a secondary visual effect.

Figure 2:
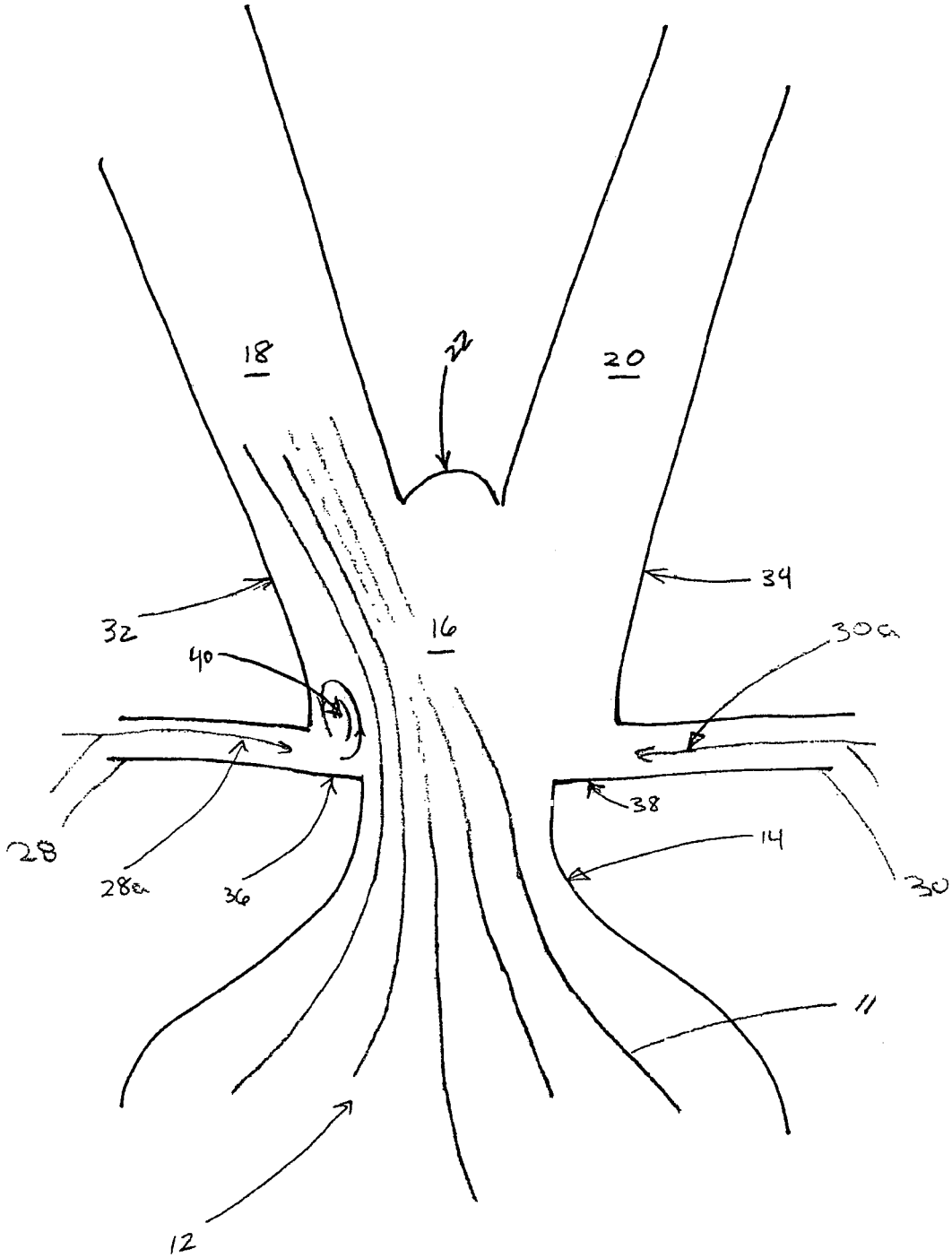
FIG. 2, in a large cross-sectional view, illustrates flow characteristics of the fluid amplifier of FIG. 1.

As shown in more detail in the expanded sectional view of FIG. 2, two opposed control stream channels 28 and 30, are operable to provide counteracting control stream fluid flows 28*a* and 30*a* respectively. Control stream channels 28 and 30 are supplied with their respective control fluid flows from external sources (not shown). Each of the control stream channels 28 and 30 is individually controllable to control the control fluid flows 28*a* and 30*a* respectively supplied.

In operation, the input stream 11 from the input channel 12 is accelerated through the power nozzle 14 into the interaction chamber 16. Say that the fluid pressure provided by control stream 28*a* from control stream channel 28 is lower than the fluid pressure provided by control stream 30*a* from control stream channel 30. As a result, the power stream flowing from the power nozzle 14 will be slightly closer to a side wall 32 of interaction chamber 16 than to an opposite side wall 34 of interaction chamber 16. Side wall 32 of interaction chamber 16 is also the extended outermost side wall of first power stream output channel 18. Similarly, side wall 34 of interaction chamber 16 is also the extended outermost side wall of the second power stream output channel 20.

This difference in fluid pressure provided by control streams 28*a* and 30*a* will cause the power stream flow axis to move toward the side wall 32. This increases the velocity of the fluid flowing adjacent to side wall 32, thereby effecting a further reduction in pressure between the power stream and the side wall 32. As a result, the power stream will continue to bend toward the side wall 32 until it finally "attaches" to side wall 32 and follows its curvature. This "boundary layer" effect may be enhanced by slightly offsetting side walls 32 and 34 with respect to the side walls of nozzle 14 to form sharp extension edges 36 and 38 and the exit of power nozzle 14. As a result of sharp extension edge 36, and the power stream being moved towards side wall 32 by control streams 28*a* and 30*a*, a low pressure bubble 40 is formed immediately downstream of sharp extension edge 36.

Thus, as shown in FIG. 2, the power stream flow exits through the first power stream output channel 18 and display port 24 due to the "boundary layer" region existing between the power stream and side wall 32. This boundary layer can be destroyed by providing a relatively low energy control stream 28*a* from control stream channel 28 into interaction chamber 16. At some point, the control stream 28*a* provided to the boundary layer between side wall 32 and the power stream will disrupt this boundary layer, such that the power stream is no longer held against side wall 32. As a result, the power stream will swing back toward the centre of the interaction chamber 16. In so doing, the power stream entrains fluid between it and the opposing side wall 34. Eventually, the power stream will switch to flow through the second power stream output channel 20 because of the boundary layer attachment between the power stream and side wall 34 of interaction chamber 16 and power stream output channel 20. The flow of the power stream in either power stream output channel 18 or 20 is stable as there is no need for continuous application of control stream flow 28*a* and 30*a* from either control stream channel 28 or 30 to maintain attachment.

The control stream fluid provided in control stream channels 28 and 30 is typically air; however, other working fluids, such as water, might possibly be used. Accordingly, switching may alternatively be effected by "closing" control stream channel 30, thereby shutting off the control stream 30*a* such that the control stream 28*a* entering the interaction chamber 16 from control stream channel 28 will create sufficient pressure imbalance across the power stream flow to effect switching. The control streams 28*a* and 30*a* may be provided from the atmosphere, or some other positive pressure source.

Decorative fountains are often operated in outdoor locations, or in environments where the fluid power stream may contain foreign matter and debris, such as rocks, vegetation or construction waste. Large diameter fluid supply lines upstream of the fluid amplifier device may easily transport debris of a size that can clog and impair the operation of the fluid amplifier. In addition, this debris can be introduced to the power stream flow where the upstream fluid supply lines are coupled to the input channel 12. Blockages caused by debris can lead to malfunctions, reduced performance, premature wear, and the need for increased maintenance in a fluid amplifier device of a decorative fountain system.

Elements such as suction strainers and discharge filters could possibly be provided in upstream fluid supply lines; however, these discharge filters and suction strainers will not stop debris that is introduced in the flow downstream from them, such as where the fluid supply line is coupled to the element channel of the fluid amplifier. In addition, elements such as suction strainers and discharge filters can be quite expensive and thus may not be incorporated into existing fluid supply lines to which a fluid amplifier is coupled. In these cases, it will be expensive to add these suction strainers or discharge filters to the fluid supply lines, and will, as discussed above, in any event not protect against debris being introduced to he downstream flow. This is particularly a problem in fluid amplifiers as fluid amplifiers rely on boundary layer phenomenon, which, in turn, rely on flow and pressure distribution through the input channel 12 and power nozzle 14, which can easily be disrupted by debris.

Figure 3:
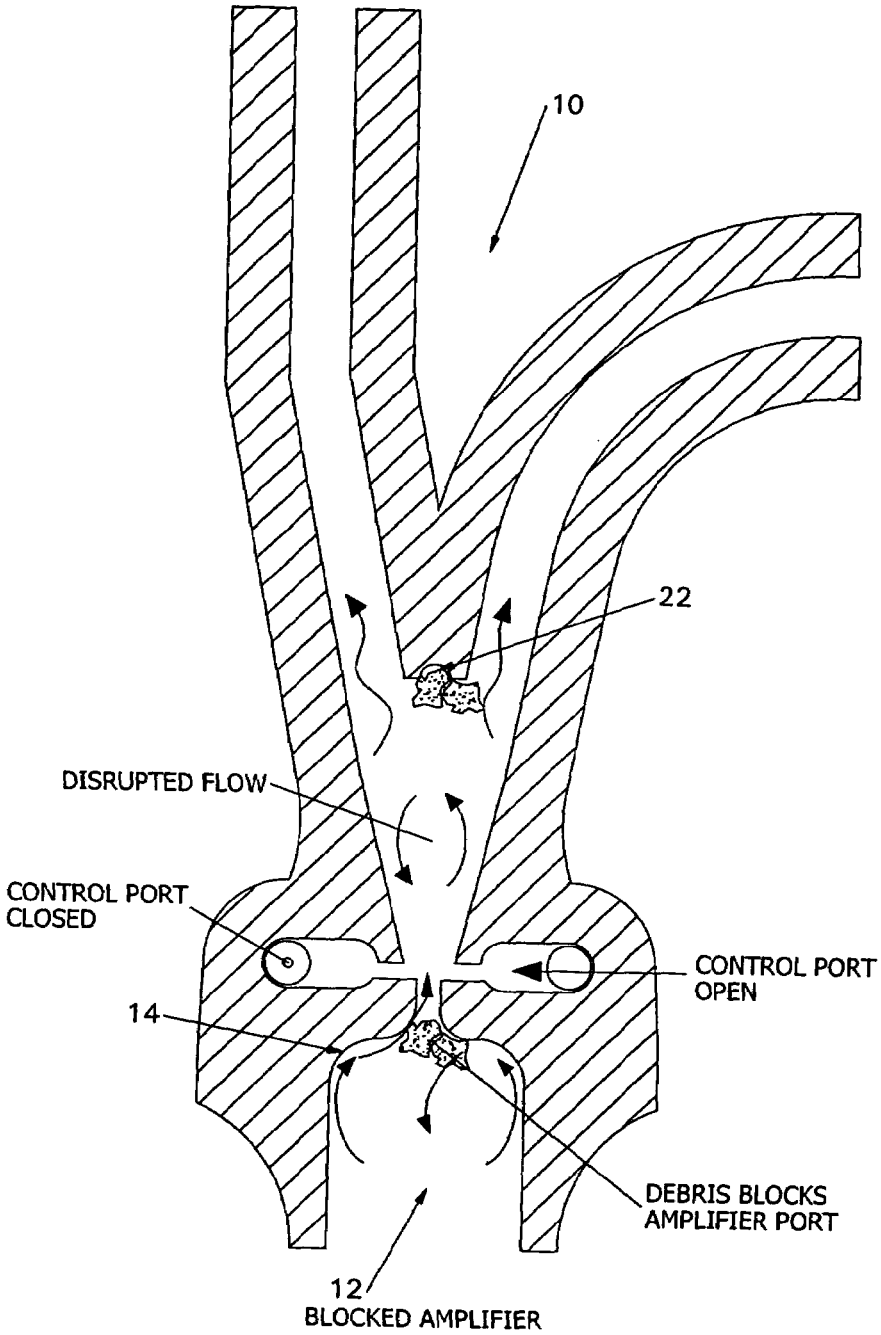
FIG. 3, in a cross-sectional view, illustrates disrupted flow patterns resulting from debris build up in a power nozzle and at a splitter of the fluid amplifier of FIG. 1.

FIG. 3 illustrates in a sectional view possible build-up of debris in the power nozzle 14 in the fluid amplifier 10 of FIG. 1. FIG. 3 also illustrates how debris can upset pressure distribution within the downstream portion of the power nozzle 14, and thereby stop the low pressure bubble 40 from forming properly. Debris that are small enough to traverse the upstream fluid supply lines, but are too large to pass through the converging power nozzle 14 of the fluid amplifier 10, may be trapped within the power nozzle 14, thereby distorting the flow or pressure distribution through the power nozzle 14, and impeding proper operation of the fluid amplifier 10. Alternatively, as shown in FIG. 3, debris can become trapped at the splitter 22, thereby disrupting the flow through either, or both, power stream output channels 18 and 20 and further impeding operation of the fluid amplifier 10.

Figure 4:
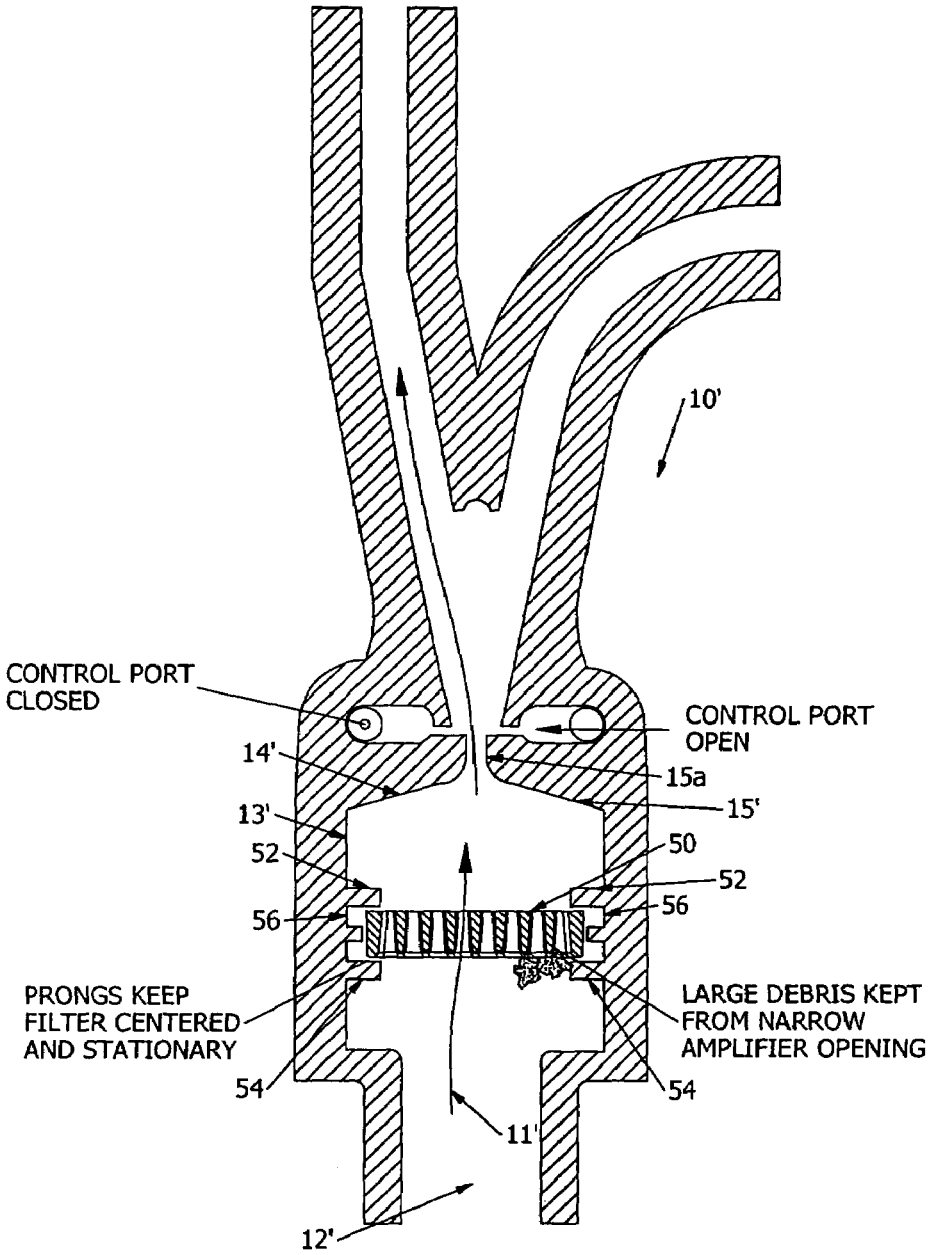
FIG. 4, in a cross-sectional view, illustrates a fluid amplifier in accordance with a preferred embodiment of the present invention.

Referring to FIG. 4, there is illustrated in a sectional view a fluid amplifier 10' in accordance with a preferred embodiment of the invention. For clarity, the same reference numerals are used to designate elements analogous to those described above in connection with FIGS. 1 and 3. However, for brevity, the description of FIG. 1 is not repeated with respect to FIG. 4.

As shown in FIG. 4, a power stream input channel 12' of the fluid amplifier 10' includes a filter element 50, through which all of an input stream 11' must pass to reach a power nozzle 14'. The filter element 50 is securable to the side wall 13' of input channel 12' by downstream flanges 52 and upstream flanges 54 that together define filter support channel 56 that is dimensioned to accept the filter element 50. Downstream and upstream flanges 52 and 54 project inwardly to an extent sufficient to secure filter element 50. Of course, other suitable securing means will be apparent to those of skill in the art, including, but not limited to, providing a filter support channel by cutting a recessed groove into the walls of the power stream input channel and eliminating the upstream and downstream flanges 52 and 54, or permanently attaching the filter element to the wall 13' of the power stream input channel 12'. Additionally, the filter element 50 can be manufactured integrally attached to the fluid amplifier 10'.

Figure 5A:
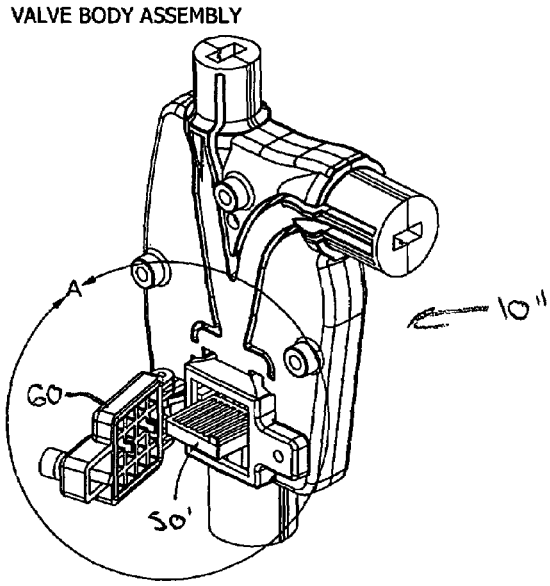
FIGS. 5*a* and 5*b*, in perspective views, illustrate a second preferred embodiment of the present invention.
Figure 5B:
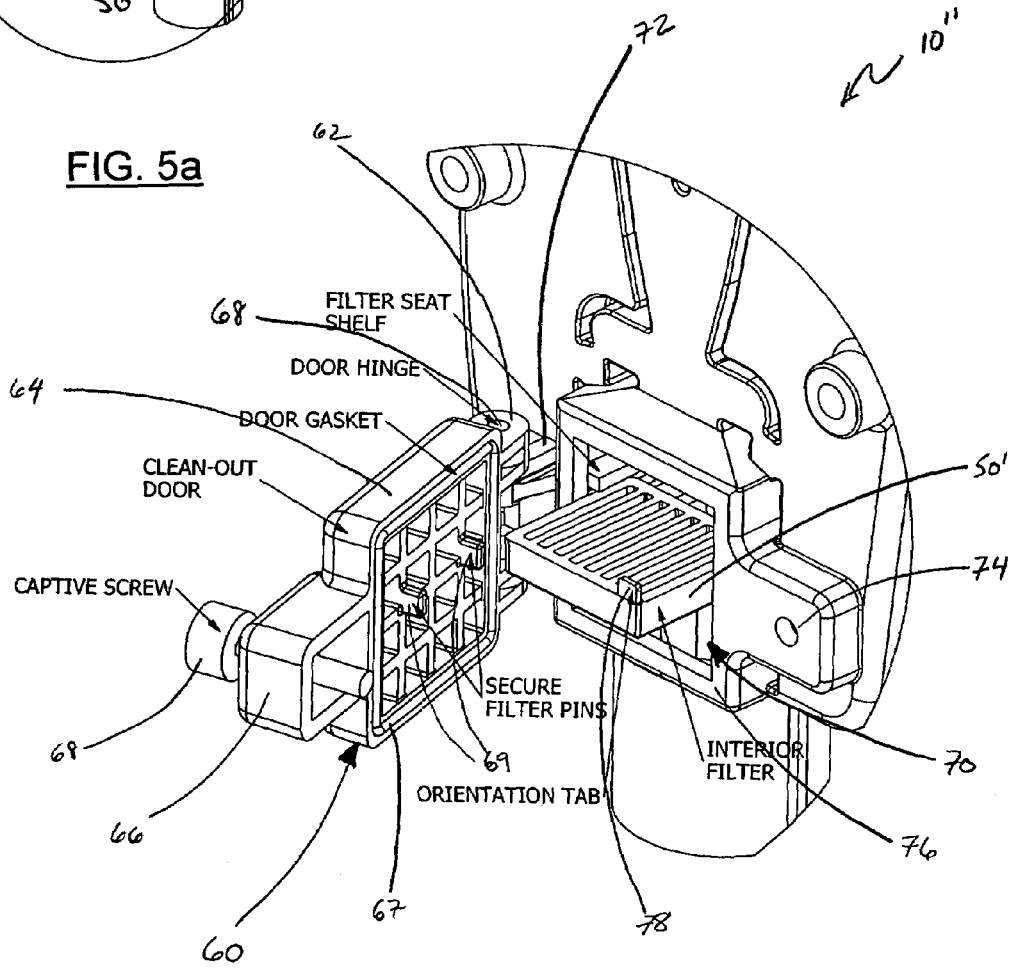

Referring to FIGS. 5*a* and 5*b*, there is illustrated in a perspective view and an enlarged perspective view respectively, a fluid amplifier 10" in accordance with a second preferred embodiment of the invention. In most respects, the fluid amplifier 10" of FIGS. 5*a* and 5*b* closely resembles that of fluid amplifier 10" of FIG. 4. However, the fluid amplifier 10" of FIGS. 5*a* and 5*b* further includes a clean-out door 60 that provides access to a filter element 50' through an access aperture 70.

As shown in FIGS. 5*a* and 5*b*, the clean-out door 60 is located adjacent to the filter element 50'. In this example embodiment, the clean-out door 60 includes an attachment flange 62, a door body 64, and a closure flange 66. The door body 64 is attached to the attachment flange 62, and the closure flange 66 is connected to the door body 64. FIGS. 5*a* and 5*b* also show the attachment flange 62, door body 64, and closure flange 66 as one integral piece. Alternatively, these can be separate pieces connected by means as understood in the art.

The attachment flange 62 is pivotably attached to a mounting flange 72 that is attached to the body of fluid amplifier 10" such that the clean-out door 60 is able to rotate from a closed position to an open position. At least one cylindrical pin 68 is inserted into complementary cavities that are formed in axial alignment in the attachment flange 62 and the mounting flange 72. It will be appreciated by those skilled in the art that alternative means are available to achieve a pivotal connection between the clean-out door 60 and the body of the fluid amplifier 10.

The door body 64 is shown in FIGS. 5*a* and 5*b* as a square prism. The inboard perimeter of the door body contains a sealing gasket 67 that is preferably made of a flexible fluid impermeable material. When the clean-out door 60 is in the closed position the sealing gasket abuts a complimentary sealing surface 76 that defines the perimeter of the access aperture 70.

The closure flange 66 is located at the distal end of the clean-out door 60. In this example, a captive screw 68 is connected to the closure flange 66 and has an externally treaded portion for screw attachment to an oppositely aligned internally threaded cavity 74 in the body of fluid amplifier 10" when the clean-out door 60 is in the closed position.

It will be appreciated by one skilled in the art that there are several variations to the design of the clean-out door 60 that are considered to be within the scope of this aspect of the invention. For example, the profile of the door body 64 and it's complementary access aperture 70 do not need to be square but may be any shape that allows access to the filter element 50'. Likewise the means by which the clean-out door 60 is mounted may include, but is not limited to, slottable attachment, clamping, latching, screw attachment or any other means that maintains the clean-out door 60 in a releasably attachable fixed location adjacent the access aperture 70.

Optionally, the clean-out door 60 does not permit the filter element 50' to be removed from the input channel, but instead only enables debris to be removed from this filter element 50'. Alternatively, as shown in FIG. 5*b*, the filter element 50' may, itself, be removable from the fluid input channel when the clean-out door 60 is opened.

In the embodiment shown in FIGS. 5*a* and 5*b*, the filter element 50' includes orientation tabs 78 integrally connected or attached to assist a user with proper orientation of the filter element 50' during installation. The door body 64 includes protrusions 69 that help to secure the filter element 50' in support channel 56.

It is important that the filter element 50 be as close as possible to the narrowest portion 15*a* of he power nozzle 15' without being so close as to disrupt the flow downstream of power nozzle 15'. Specifically, given that the narrowest portion 15*a* of the power nozzle 15' has a width of w, then the filter should be set back from this narrowest point 15*a* of power nozzle 15' by no less than five times w, to prevent disruption of the flow of the power stream downstream from the power nozzle 15', and no further than fifteen times w to prevent the fluid amplifier from being overly large. Preferably, the filter element 50 is no closer than six times w from the narrowest point 15*a* of power nozzle 15', and is no further than twelve times w from the narrowest point 15*a* of power nozzle 15'.

As shown in FIG. 4, the input channel 12' and power nozzle 14' are preferably cast or molded as a single element, such that the side wall 13 of the input channel 12' merges with the side wall 15 of the power nozzle 14', without any gap or discontinuity through which debris can be introduced into the flow, to provide a substantially fluid impervious surface at this juncture. Consequently, and also as a result of the filter 50 being mounted within the input channel 12' downstream from the connection of this input channel 12' with any fluid supply line, the debris introduced to the power stream flow by the fluid supply line, or at the juncture of the fluid supply line and input channel 12, would typically be removed by filter 12. As described above in connection with FIG. 5, this debris can subsequently be removed via the clean-out door 60.

Other variations and modifications of the invention are possible. For example, the input channel and power nozzle might be welded together, glued together or fastened by some other means to prevent any gap from being formed at their juncture such that the interior surface of the power nozzle and the input channel downstream from the filter is a closed one-piece surface. In other embodiments, the input channel and power nozzle might even be fitted or power-fitted together by some suitable coupling. However, these elements can readily be fitted together in a controlled setting, such as in a manufacturing facility, where debris are less likely to be introduced, than in an actual work site. Further, in a controlled setting such as in a manufacturing facility, the coupling of the input channel and power nozzle could be far more effectively sealed against the subsequent introduction of debris. All such modifications or variations are believed to be with the scope of the invention as defined by the claims appended hereto.

The invention claimed is:

1. A fluid amplifier comprising:

an interaction chamber;

an upstream conduit for issuing a power stream flow into the interaction chamber;

a plurality of output channels located downstream of the interaction chamber;

a first control stream channel in fluid communication with the interaction chamber for controllably directing a first control fluid flow into the interaction region;

a second control stream channel in fluid communication with the interaction chamber for controllably directing a second control fluid flow into the interaction region;

a filter interposed in the upstream conduit for filtering the power stream, wherein an interior surface of the upstream conduit downstream from the filter is sealed to impede debris from being introduced to the power stream downstream from the filter; and, an access means to the upstream conduit for removing debris from the filter, wherein the access means is spaced from the plurality of output channels.

2. The fluid amplifier of claim 1 wherein the access means is spaced from the interaction chamber, and the interior surface comprises a one-piece fluid impervious surface surrounding the upstream conduit downstream from the access means.

3. The fluid amplifier of claim 2 wherein the power nozzle and the input channel are one of welded, power-fitted and glued together, to provide a substantially fluid impervious surface.

4. The fluid amplifier of claim 1 wherein the upstream conduit comprises an input channel containing the filter, and a power nozzle for receiving an input stream from the input channel and for issuing the power stream into the interaction chamber.

5. The fluid amplifier of claim 1 wherein the access means comprises a clean-out door.

6. The fluid amplifier of claim 5 wherein (i) the clean-out door is moveable between an open position for removing debris from the filter and a closed position, and (ii) when the clean-out door in the open position, the one-piece fluid impervious surface continues to surround the upstream conduit.

7. The fluid amplifier as defined in claim 6 wherein the clean-out door is attached to the upstream conduit in both the open position and the closed position.

8. The fluid amplifier as defined in claim 6 wherein the clean-out door comprises a sealing gasket; and, the upstream conduit comprises a complimentary sealing surface for abutting the sealing gasket of the clean-out door when the clean-out door is in the closed position, the sealing gasket being made of a flexible and permeable material to provide a fluid seal about the clean out door when the clean out door is in the closed position.

9. The fluid amplifier as defined in claim 6 wherein the clean-out door is attached to the upstream conduit by a mounting flange, and the clean out door is pivotable about the mounting flange from the open position to the closed position.

10. The fluid amplifier of claim 1 wherein the upstream conduit comprises a power nozzle for an input channel and a power nozzle for receiving an input stream from the input channel and for issuing the power stream into the interaction chamber, the power nozzle having a narrowest point having a lateral linear dimension w; and, the filter is spaced from the narrowest point of the power nozzle by a linear distance between five times w and fifteen times w.

11. The fluid amplifier as defined in claim 10 wherein the linear distance of the filter from the narrowest point of the power nozzle is between six times w and twelve times w.

12. The fluid amplifier as defined in claim 1 where in the upstream conduit comprises an input channel and a power nozzle for receiving an input stream from the input channel and for issuing the power stream into the interaction chamber, wherein the filter is as close as possible to the power nozzle without disrupting the power stream.

13. The fluid amplifier of claim 1 wherein the filter is removable from the upstream conduit through the access means.

* * * * *